US007241327B2

(12) United States Patent
Henmi et al.

(10) Patent No.: US 7,241,327 B2
(45) Date of Patent: Jul. 10, 2007

(54) IRON-BASED SINTERED ALLOY WITH DISPERSED HARD PARTICLES

(75) Inventors: Hiroji Henmi, Kumagaya (JP); Akiyoshi Ishibashi, Kumagaya (JP)

(73) Assignee: Riken Corporation, Tokyo (JP)

( * ) Notice: Subject to any disclaimer, the term of this patent is extended or adjusted under 35 U.S.C. 154(b) by 273 days.

(21) Appl. No.: 11/126,568

(22) Filed: May 10, 2005

(65) Prior Publication Data

US 2005/0252338 A1 Nov. 17, 2005

(30) Foreign Application Priority Data

May 17, 2004 (JP) ..... P2004-146854

(51) Int. Cl.
*B22F 3/00* (2006.01)

(52) U.S. Cl. ..... 75/246; 75/243

(58) Field of Classification Search ..... 75/243, 75/246

See application file for complete search history.

(56) References Cited

U.S. PATENT DOCUMENTS 5,308,702 A * 5/1994 Furukimi et al. ..... 428/403
5,498,483 A * 3/1996 Ito et al. ..... 428/552
6,066,191 A * 5/2000 Tanaka et al. ..... 75/246
6,613,120 B2 * 9/2003 Ando et al. ..... 75/246
6,802,883 B2 * 10/2004 Henmi et al. ..... 75/240
2003/0177863 A1 * 9/2003 Koyama ..... 75/241

* cited by examiner

*Primary Examiner*—Roy King
*Assistant Examiner*—Ngoclan T. Mai
(74) *Attorney, Agent, or Firm*—Bachman & LaPointe. P.C.

(57) ABSTRACT

An iron-based sintered alloy having improved thermal and mechanical strength is provided. The iron-based sintered alloy with dispersed hard particles comprises: a matrix comprising, by weight, 0.4 to 2% silicon (Si), 2 to 12% nickel (Ni), 3 to 12% molybdenum (Mo), 0.5 to 5% chromium (Cr), 0.6 to 4% vanadium (V), 0.1 to 3% niobium (Nb), 0.5 to 2% carbon (C), and the reminder of iron (Fe); and hard particles comprising 60 to 70% molybdenum (Mo), 0.3 to 1% boron (B), 0.1% or less carbon (C), and the reminder of iron (Fe). The hard particles are dispersed in the matrix in an amount in the range of 3 to 20% based on the entire alloy. They are sintered to produce the iron-based sintered alloy. Addition of boron into the ferromolybdenum hard particles enhances the wettability of the ferromolybdenum hard particles to prevent the hard particles from falling off the matrix. Thus, the adhesive property between the matrix and the hard particles is improved, thereby enhancing the thermal and mechanical strength of the iron-based sintered alloy.

6 Claims, 3 Drawing Sheets

IRON-BASED SINTERED ALLOY WITH DISPERSED HARD PARTICLES

BACKGROUND OF THE INVENTION

1. Field of the Invention

The present invention relates to an iron-based sintered alloy with dispersed hard particles, and more particularly, to an iron-based sintered alloy with dispersed hard particles suitable for a valve seat of an automobile engine.

2. Description of the Related Art

The combustion temperature of an automobile engine has been increasing as the power of the automobile engine increases, or as clean fuel such as LPG (Liquid Petroleum Gas) or CNG (Compressed Natural Gas) is used for reducing environmental load. Thus valve seats of engine components tend to be subjected to larger thermal and mechanical loads. To address the problems caused by the increased thermal load, materials such as, for example, chromium (Cr), cobalt (Co), and tungsten (W) are added to the raw material of an iron-based sintered alloy to enhance the strength of valve seats at high temperature. The strength required for the increased mechanical load can be enhanced by means of high pressure compacting, cold forging, powder forging, high temperature sintering, and the like. However, since the thermal and mechanical loads on a valve seat of an engine component are still increasing, it is conceivable that an engine will generate thermal and mechanical loads that conventional iron-based sintered alloys may not resist. For example, the thermal conductivity of the alloy can be enhanced through copper infiltration in which a low melting point material such as copper (Cu) is infiltrated into the internal pores of an iron-based sintered alloy, so that the thermal load on the valve seat can be reduced. However, the strength of the infiltrated iron-based sintered alloy is disadvantageously lowered by means of the infiltrated copper. In addition, secondary sintering is required to pack the alloy after primary sintering, thereby increasing the production cost.

As disclosed in Japanese Patent Laid-Open Publication No. Hei 5-93241, the present inventors have proposed iron-based sintered alloys having enhanced strength in which hard particles comprising molybdenum (Mo), carbon (C), and iron (Fe) are dispersed in an iron (Fe)-molybdenum (Mo)-nickel (Ni)-carbon (C) matrix. This publication discloses a technique for improving wear resistance through mixing boron (B) with the matrix to promote sintering and to form borides. Japanese Patent Laid-Open Publication No. Hei 9-53158 discloses iron-based sintered alloys with dispersed hard phase having enhanced strength through dispersion of hard particles comprising chromium (Cr), molybdenum (Mo), cobalt (Co), carbon (C), silicon (Si), and iron (Fe) in an iron (Fe)-molybdenum (Mo)-chromium (Cr)-nickel (Ni)-carbon (C) matrix, and also having improved wear resistance at high temperatures through formation of high-alloy phases through diffusion. Japanese Patent Laid-Open Publication No. 2000-73151 discloses iron-based sintered alloys with dispersed hard particles having improved wear resistance at high temperatures through dispersion of one or both of hard particle comprising chromium (Cr), molybdenum (Mo), cobalt (Co), carbon (C), silicon (Si), and iron (Fe) and hard particle comprising molybdenum (Mo), carbon (C), and iron (Fe) in an iron (Fe)-molybdenum (Mo)-chromium (Cr)-nickel (Ni)-vanadium (V)-carbon (C) matrix.

In an iron-based sintered alloy, a hard particle serves as a source of alloy elements, and also enhances deformation resistance at high temperatures. However, a hard particle such as a cobalt-based particle or a nickel-based particle serving as an alloy-source softens or hardens the alloy due to excessive alloying through diffusion of the alloy elements into a matrix. Also, a hard particle composed of intermetallic compounds, ceramics, carbides, oxides, and the like enhances the deformation resistance of the matrix, but has poor adhesive property (wettability) with the matrix, so that the hard particle tends to easily fall off the alloy matrix. The hard particles described above may deteriorate the wear resistance of the iron-based sintered alloy.

By dispersing hard particles of ferromolybdenum (Fe—Mo) composed of molybdenum and iron in a matrix containing silicon, nickel, molybdenum, chromium, vanadium, niobium, carbon, and iron, the wear resistance can be improved through a paving stone effect. However, since the diffusivity of molybdenum in the iron-based matrix is low, only the region around the added ferromolybdenum hard particles is strengthened, while the other regions are not strengthened. Further, since the bonding between the ferromolybdenum particles and the iron-based matrix is weak, the ferromolybdenum particles may easily fall off the iron-based matrix.

SUMMARY OF THE INVENTION

It is therefore an object of the present invention to provide an iron-based sintered alloy with dispersed hard particles in which the wettability of hard particles is improved; i.e., the adhesion property of the hard particles with the matrix is improved to prevent the hard particles falling off the matrix. It is also an object of the invention to provide an iron-based sintered alloy with dispersed hard particles having improved heat resistance and wear resistance through improving the thermal strength and mechanical strength of an iron-based sintered alloy.

According to one aspect of the present invention, there is provided an iron-based sintered alloy with dispersed hard particles produced through sintering which comprises a matrix containing, by weight, 0.4 to 2% silicon (Si), 2 to 12% nickel (Ni), 3 to 12% molybdenum (Mo), 0.5 to 5% chromium (Cr), 0.6 to 4% vanadium (V), 0.1 to 3% niobium (Nb), 0.5 to 2% carbon (C), and the reminder of iron (Fe) and hard particles dispersed in the matrix in an amount of 3 to 20% based on the entire alloy. The hard particle comprises 60 to 70% molybdenum (Mo), 0.3 to 1% boron (B), 0.1% or less carbon (C), and the reminder of iron (Fe). If a very small amount of boron, which has a smaller atomic radius, is added to ferromolybdenum hard particles, the sphericity of the hard particles is increased. Further, boron, among the alloy elements in the hard particles, having high diffusivity in the matrix, diffuses into the matrix so that the wettability of ferromolybdenum is improved during the sintering process. As a result, the hard particles are stabilized and firmly bonded to the iron-based matrix. The improved adhesive property between the matrix and the hard particles results in enhanced grain boundary strength. Thus, the hard particles are prevented from falling off the matrix, thereby enhancing the thermal and mechanical strength of the iron-based sintered alloy. When the amount of boron in the hard particle is less than 0.3%, the adhesive property with the matrix is not satisfactorily improved. When the amount of boron exceeds 1%, the hard particles become brittle. A carbon steel alloy material having sufficiently high heat resistance and wear resistance can be produced by use of the iron-based sintered alloy with dispersed hard particles according to the present invention.

The present invention provides an iron-based sintered alloy with dispersed hard particles having excellent wear resistance even when heavy load is applied to the alloy at high temperature. Thus, the reliability of the product can be improved.

DETAILED DESCRIPTION OF THE INVENTION

Figure 1:
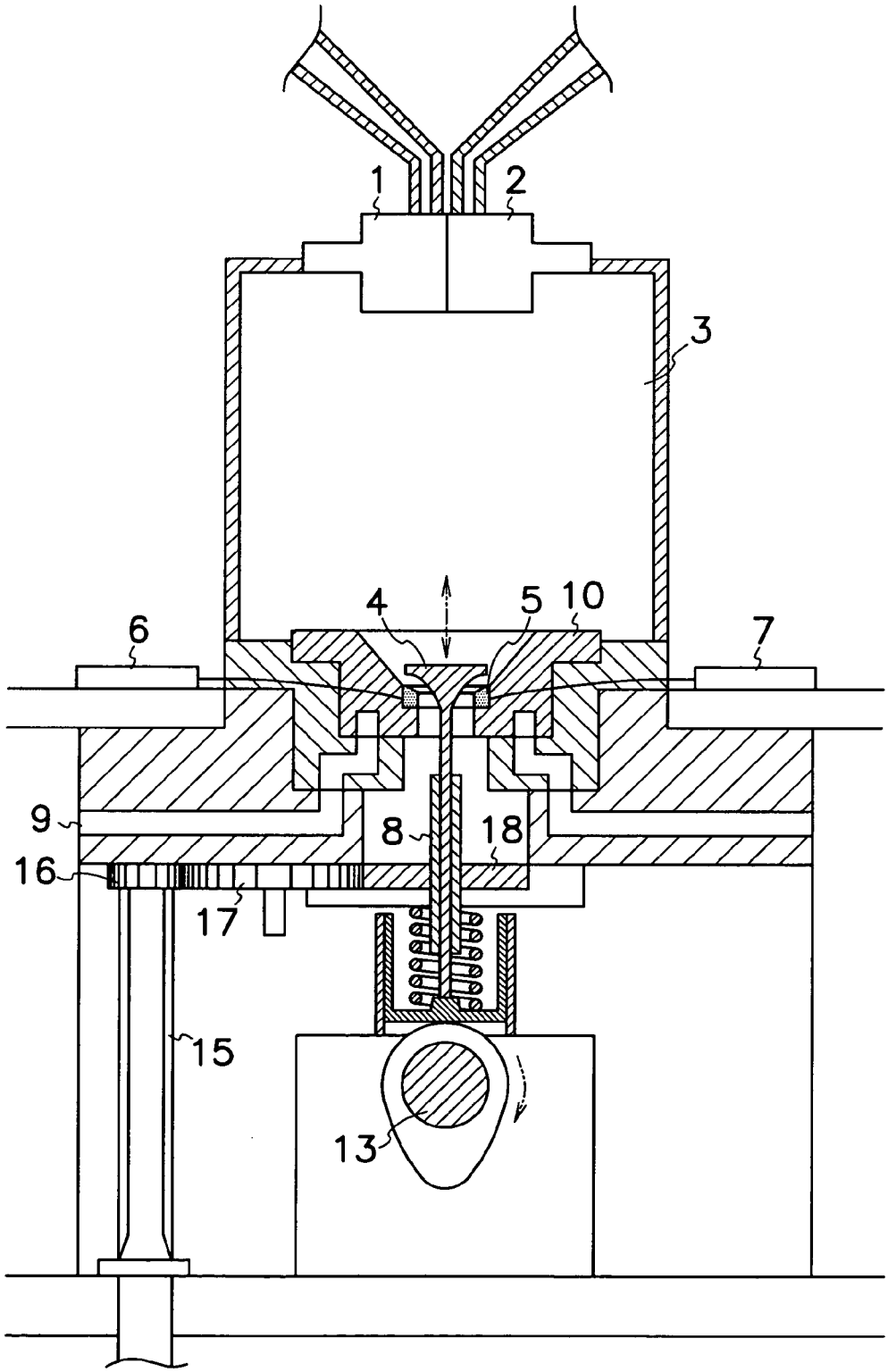
FIG. 1 is a partial sectional view of a beating wear testing machine.

An embodiment of the iron-based sintered alloy with dispersed hard particles according to the present invention will next be described in more detail with reference to FIGS. 1 to 3. The unit "%" in the embodiment is represented by weight based percent unless otherwise specified.

The iron-based sintered alloy with dispersed hard particles comprises a matrix composed of, based on the matrix, 0.4 to 2% silicon (Si), 2 to 12% nickel (Ni), 3 to 12% molybdenum (Mo), 0.5 to 5% chromium (Cr), 0.6 to 4% vanadium (V), 0.1 to 3% niobium (Nb), 0.5 to 2% carbon (C), and the reminder of iron (Fe), and hard particles composed of, based on the hard particle, 60 to 70% molybdenum (Mo), 0.3 to 1% boron (B), 0.1% or less carbon (C), and the reminder of iron (Fe) dispersed in the matrix in an amount of 3 to 20% based on the entire alloy.

The amount of silicon in the matrix should be in the range of 0.4 to 2%. When the amount is less than 0.4%, the adhesion property of the oxide layer is not satisfactory. When the amount exceeds 2%, the base raw material powder becomes hard and brittle, and the formability and workability of the alloy are lowered. As a result, the machinability and wear resistance of the alloy deteriorate. The amount of silicon is, therefore, in the range of 0.4 to 2%, preferably in the range of 0.8 to 1.4%.

When the amount of nickel is in the range of 2 to 12%, sintering is promoted and the adhesion property of the oxide layer is improved. The nickel dissolves into the iron-based matrix to enhance the strength of the sintered alloy, thereby indirectly improving the wear resistance. When the amount of nickel is less than 2%, the wear resistance is not satisfactorily improved. When the amount exceeds 12%, the amount of austenite increases, resulting in poor machinability. In addition, the thermal expansion coefficient of the matrix becomes higher, and permanent strain is accumulated during heat cycling in an engine, so that a valve seat produced from the alloy tends to come off. The amount of nickel is, therefore, in the range of 2 to 12%, preferably in the range of 5 to 8%.

When the amount of molybdenum is in the range of 3 to 12%, an oxide layer having self-lubricity is produced, resulting in the improvement of the wear resistance particularly at low temperatures. When the amount is less than 3%, the above effect is not obtained satisfactorily. When the amount exceeds 12%, an excessive amount of carbides is disadvantageously formed, resulting in poor machinability and poor oxidation resistance. The amount of molybdenum is, therefore, in the range of 3 to 12%, and preferably in the range of 4 to 8%.

When the amount of chromium is in the range of 0.5 to 5%, a dense oxide layer is formed, resulting in the improvement of the oxidation resistance. When the amount is less than 0.5%, the above effect is not obtained satisfactorily. When the amount exceeds 5%, an excessive amount of carbides is disadvantageously formed, resulting in poor machinability. In addition, chromium tends to react with carbon to form carbides. When chromium in the form of metallic chromium (Cr) or iron-chromium compound ($Fe_m$-$Cr_n$) is mixed with a raw material, the chromium forms carbides rather than diffusing into the matrix. In order to fully obtain the effect of chromium, a raw material powder in which chromium (Cr) is pre-alloyed may be employed. The amount of chromium is, therefore, in the range of 0.5 to 5%, and preferably in the range of 0.7 to 3%.

When the amount of vanadium is in the range of 0.6 to 4%, the hardness and strength of the matrix are improved at high temperatures, and thus the wear resistance of the alloy is improved. When the amount is less than 0.6%, the above effect is not satisfactorily obtained. In addition, the alloy is hardened significantly through precipitation hardening, and thus the temper softening resistance is not obtained satisfactorily. When the amount exceeds 4%, an excessive amount of carbides is disadvantageously formed, resulting in poor machinability and poor oxidation resistance. Since the atomic radius of molybdenum (Mo) and vanadium (V) is large, these elements are not easy to diffuse into the matrix. In order to dissolve a sufficient amount of molybdenum (Mo) and vanadium (V) in the matrix to form fine carbides and intermetallic compounds, a raw material powder in which molybdenum (Mo) and vanadium (V) are pre-alloyed may be employed. The amount of vanadium is, therefore, in the range of 0.6 to 4%, and preferably in the range of 0.7 to 3.2%.

When the amount of niobium is less than 0.1%, the strength at high temperatures is not satisfactorily improved. When the amount exceeds 3%, an excessive amount of carbides is formed, resulting in poor machinability. The amount of niobium is, therefore, in the range of 0.1 to 3%, and preferably in the range of 0.3 to 1%.

When the amount of carbon is in the range of 0.5 to 2%, the carbon reacts with molybdenum, vanadium, and chromium to form carbides, resulting in the improvement of the wear resistance. When the amount is less than 0.5%, ferrite ($\alpha$ solid solution) is formed and the wear resistance of the alloy is lowered. When the amount exceeds 2%, an excessive amount of martensite and carbides is formed to cause poor machinability, and the alloy becomes brittle. The amount of carbon can be determined by taking the amount of nickel, chromium, molybdenum, and vanadium and the amount and kind of the hard particles into consideration such that ferrite, martensite, and carbides are not excessively formed.

The hard particles dispersed in the matrix enhance the strength of the alloy through dispersion strengthening. The alloy elements in the hard particles diffuse therefrom into the matrix during sintering to form high-alloy phases around the hard particles, resulting in the significant improvement of the wear resistance. The amount of the hard particles added to the matrix is preferably in the range of 3 to 20% based on the entire alloy. When the amount is less than 3%, the wear resistance is not satisfactorily improved. When the amount exceeds 20%, the wear resistance is not improved in proportion to the amount of the hard particles added to the matrix, so that the cost of the final product may become higher without any further benefit to the product itself. In addition, the alloy becomes harder and more brittle, resulting in lowered strength and poor machinability. As the added amount of the hard particles increases, the wear of the mating valve tends to be increased. From the above viewpoints, the amount of the hard particles exceeding 20% is not preferable. In order to obtain reasonable formability during manufacturing, and to disperse the hard particles into other raw material powders during mixing, the hard particles having a spherical shape formed by means of an atomizing method or a spray-dry method are preferably employed. The sphericity of the hard particles is improved through addition of boron to the hard particles.

The hard particles are composed of 60 to 70% molybdenum and the reminder of iron. The hard particles are formed and dispersed into the matrix as ferromolybdenum hard particles, resulting in the improvement of the wear resistance. Boron has a smaller atomic radius and is added in an amount in the range of 0.3 to 1% to the ferromolybdenum hard particles. During sintering, each of the alloy elements in the hard particles, particularly boron, diffuses into the matrix, resulting in the improvement of the wettability of the ferromolybdenum hard particles with the matrix. The hard particles are thus stabilized and adhere firmly to the matrix. The grain boundary strength is enhanced through the improvement of the adhesive properties of the matrix and the hard particles. When the amount of boron in the hard particles is lass than 0.3%, the adhesive properties of the hard particles with the matrix are not satisfactorily improved. When the amount exceeds 1%, the hard particles become brittle. When the amount of carbon exceeds 0.1%, the hard particles become harder and brittle. Therefore, the amount of carbon should be 0.1% or less. Preferably, the hard particles are composed of intermetallic compounds rather than carbides. However, the amount of carbon contained in the hard particles cannot be lowered below a certain level due to the manufacturing techniques. In the present invention, the allowable amount of carbon contained in the hard particles as an impurity is set to 0.1% or less, this amount being controlled to be as low as possible.

The iron-based sintered alloy of the embodiment of the present invention contains at least one solid lubricant selected from the group consisting of fluorides such as lithium fluoride (LiF), calcium fluoride ($CaF_2$), and barium fluoride ($BaF_2$), nitrides such as silicon nitride ($Si_3N_4$), and boron nitride (BN), sulfides such as manganese sulfide (MnS), molybdenum disulfide ($MOS_2$), and tungsten disulfide ($WS_2$) in an amount in the range of 1 to 20% based on the entire alloy. The solid lubricant is dispersed in the matrix together with the hard particles. The solid lubricant positioned in a sliding area of a valve seat experiences a shear force, and the wear between the hard particles and the opposite side caused by direct contact is reduced, resulting in the reduction in the wear amount of the iron-based sintered alloy. The solid lubricant composed of fluoride, nitride, or sulfide is not decomposed and does not react with the matrix material, and the lubricity is maintained even at a high temperature, thereby preventing the wear of the iron-based sintered alloy when the alloy is heated. The holding property of the solid lubricant may be improved if a solid lubricant having a relatively low melting point selected from among lithium fluoride, calcium fluoride, barium fluoride, silicon nitride, boron nitride, manganese sulfide, molybdenum disulfide, and tungsten disulfide is employed. Therefore, the solid lubricant is prevented from falling off the matrix. For example, a valve seat is heated to temperatures in the range of 200 to 600° C. in an engine, but the solid lubricant does not decompose in this temperature range. Thus, the self-lubricant properties are maintained, and the iron-based sintered alloy exhibits excellent wear resistance at this high temperature range. A carbon steel alloy material having excellent thermal resistance and wear resistance can be produced from the iron-based sintered alloy with dispersed hard particles of the present invention. In addition, the thermal strength and the mechanical strength of the iron-based sintered alloy can be improved without carrying out a secondary treatment such as copper infiltration, resulting in the reduction of the production cost.

During production of the iron-based sintered alloy with dispersed hard particles, a pre-alloy powder comprising, based on the pre-alloy powder, 0.4 to 2.5% silicon (Si), 1 to 4% molybdenum (Mo), 0.5 to 5% chromium (Cr), 1 to 5% vanadium (V), 0.1 to 3% niobium (Nb), 0.8% or less carbon (C), and the reminder of iron (Fe) is mixed with additive raw material powder, thereby preparing a base raw material powder comprising, based on the base raw material powder, 0.4 to 2% silicon (Si), 2 to 12% nickel (Ni), 3 to 12% molybdenum (Mo), 0.5 to 5% chromium (Cr), 0.6 to 4% vanadium (V), 0.1 to 3% niobium (Nb), 0.5 to 2% carbon (C), and the reminder of iron (Fe).

The pre-alloy powder is advantageously employed to obtain a microstructure in which silicon, molybdenum, chromium, vanadium, and niobium are uniformly dissolved or dispersed in the matrix. If chromium is added as an element, it reacts with carbon in the additive raw material powder to form hard carbides having poor adhesive properties with the matrix. Preferably, chromium is dissolved into the pre-alloy powder in advance. Similarly, if vanadium and niobium are added as an element, they react with carbon or nitrogen in the additive raw material powder to form hard carbides or nitrides. Preferably, vanadium and niobium are dissolved into the pre-alloy powder in advance. In addition, in order to disperse silicon uniformly into the matrix, silicon is preferably dissolved into the pre-alloy powder in advance. On the other hand, a part of molybdenum is preferably contained in the additive raw material powder, and the entire amount of nickel is preferably contained in the additive raw material powder. The pre-alloy powder promotes ferrite formation, resulting in the improvement of the formability of the product. In the present embodiment, the average grain size of the pre-alloy powder is 149 μm or less.

When the pre-alloy powder contains a large amount of silicon, molybdenum, chromium, vanadium, niobium, and nickel, the matrix becomes hard, and the formability is significantly reduced. Therefore, the rest of the required amount for each element, which is not contained in the pre-alloy powder, is mixed with the pre-alloy powder as the additive raw material powder (pure metal powders or alloy powders). Examples of the additive raw material powder include metallic nickel powder, carbonyl nickel powder, metallic molybdenum powder, and graphite powder. In the present embodiment, a fine pure metallic powder under 325 mesh is employed as the additive raw material powder.

A base raw material powder of Fe—Mo—Cr—V—Nb or Fe—Mo—Cr—V—Nb—Ni is obtained through mixing the pre-alloy powder and the additive raw material powder. The composition of the resultant mixed powder and the matrix of the iron-based sintered alloy can be determined through adjusting the mixing ratio of the pre-alloy powder to the additive raw material powder, and the ratio is specified as needed. Specifically, the mixing ratio of the pre-alloy powder to the additive raw material powder preferably falls within the range of 3:2 to 18:1. When the mixing ratio is less than 3:2, an element contained in the additive raw material powder tends to react with carbon to form an excessive amount of carbides. When the mixing ratio is more than 18:1, the alloy becomes brittle due to lack of the additive raw material powder. A dense oxide layer is uniformly formed when vanadium and silicon are contained in the base raw material powder, and thus the friction coefficient of the sliding area is lowered. Therefore, an iron-based sintered alloy with dispersed hard particles having excellent wear resistance can be obtained.

Next, the base raw material powder is uniformly mixed with the hard particles (3 to 20%) containing 60 to 70% molybdenum (Mo), 0.3 to 1% boron (B), 0.1% or less carbon (C), and the reminder of iron (Fe), and at least one solid lubricant (1 to 20%) selected from the group consisting of lithium fluoride (LiF), calcium fluoride ($CaF_2$), barium fluoride ($BaF_2$), silicon nitride ($Si_3N_4$), boron nitride (BN), manganese sulfide (MnS), molybdenum disulfide ($MOS_2$), and tungsten disulfide ($WS_2$), thereby preparing a mixed powder. In this case, the mixed powder is prepared through mixing of, based on the mixed powder (of the entire alloy), 60 to 96 wt. % of the base raw material powder (matrix), 3 to 20 wt. % of the hard particles, and 1 to 20 wt. % of the solid lubricant. When the solid lubricant is not added to the mixed powder, the mixed powder is prepared through mixing of 3 to 20 wt. % of the hard particles and the reminder of the base raw material powder. In order to obtain better formability and release property from a mold, a stearate (for example, zinc stearate) serving as a mold lubricant may be added to the mixed powder in an amount of approximately 5 wt. % based on 100 wt. % of the mixed powder.

Subsequently, the resultant mixed powder is pressed to form a green compact, and the resultant green compact is heated to dewax. After the dewaxing process, the green compact is sintered to form an iron-based sintered alloy with dispersed hard particles. The mixed powder is pressed by means of a press method by use of a well-known mold or the like. A pressure of approximately 600 to 700 MPa is employed, and the density of the resultant green compact is preferably 6.0 g/cm$^3$ or more. The green compact is heated to temperatures in the range of 450 to 700° C. to evaporate any binder contained in the green compact. The heating period may be selected according to the type and the amount of the binder. The dewaxed green compact is sintered at, for example, 1140 to 1200° C. for between 0.5 and 2 hours. The sintering process is preferably carried out in vacuum or under a gas mixture atmosphere of $N_2$ and $H_2$. No particular limitation is imposed on the sintering method. Examples of the sintering method include pressureless sintering, high pressure sintering, HIP (Hot Isostatic Pressing), and HP (Hot Pressing). The resultant sintered compact is subjected to tempering to remove residual stresses, and thus the hardness and strength at high temperatures can be improved. The tempering is carried out at temperatures in the range of 500 to 700° C. for between 0.5 and 2 hours.

EXAMPLES

The iron-based sintered alloy with dispersed hard particles according to the present invention will next be described with reference to the examples. Examples 1 to 6 are exhaust valve seats of an automobile engine in which the present invention is applied, and Comparative Examples 7 and 8 are exhaust valve seats of the prior art. Table 1 shows the composition of the matrix by weight % and the raw materials of the hard particles and the solid lubricant for Examples 1 to 6 and Comparative Examples 7 and 8. The mark "X" in Table 1 indicates that the reminder of the composition of the matrix is substantially iron (Fe) except for unavoidable impurities.

TABLE 1

| Example | Matrix Composition (wt %) | | | | | | | | Hard Particle | Solid Lubricant |
|---|---|---|---|---|---|---|---|---|---|---|
| | Fe | Si | Cr | Mo | V | Ni | Nb | C | | |
| 1 | X | 1 | 1 | 5 | 3 | 7 | 0.5 | 0.8 | FeMoB | $CaF_2$ |
| 2 | X | 1 | 1 | 5 | 3 | 7 | 0.5 | 1 | FeMoB | $CaF_2$ |
| 3 | X | 0.4 | 0.5 | 3 | 0.6 | 3 | 0.5 | 0.8 | FeMoB | $CaF_2$ |
| 4 | X | 0.4 | 1 | 5 | 3 | 7 | 0.5 | 0.8 | FeMoB | $CaF_2$ |
| 5 | X | 1 | 1 | 5 | 3 | 7 | 3 | 2 | FeMoB | $CaF_2$ |
| 6 | X | 1.4 | 3 | 5 | 3 | 7 | 0.5 | 0.8 | FeMoB | $CaF_2$ |
| 7 | X | 1 | 1 | 5 | 3 | 7 | — | 0.8 | FeMo | $CaF_2$ |
| 8 | X | 0.8 | 1 | 3 | 3 | 4 | 0.5 | 0.8 | FeMo | $CaF_2$ |

In Examples 1 to 6, an iron powder serving as a pre-alloy powder having a particle size distribution with a peak in the range of 150 to 200 mesh and comprising 2% molybdenum (Mo), 0.5 to 3% chromium (Cr), 0.4 to 1.4% silicon (Si), 0.6 to 3% vanadium (V), 0.5 to 3% niobium (Nb) was mixed with carbonyl nickel, molybdenum (Mo), and graphite powders under 325 mesh serving as additive raw material powder, thereby preparing base raw material powders having compositions shown in Table 1.

The base raw material powder was mixed with ferro-molybdenum powder serving as the hard particles composed of 60.87% molybdenum (Mo), 0.89% boron (B), 0.05% carbon (C), and the reminder of iron (Fe) and calcium fluoride ($CaF_2$) powder serving as a solid lubricant, thereby preparing a mixed powder. The hard particles under 200 mesh having a particle size distribution with a peak at 325 mesh were employed. The solid lubricant having a particle size distribution with a peak in the range of 325 to 400 mesh was employed. The composition of the resultant mixed powders was 63 to 82.4% of the pre-alloy powder, 3 to 12% of the carbonyl nickel powder, 1 to 10% of the molybdenum powder, 0.6 to 2% of the graphite powder, 10% of the Fe—Mo—B powder, and 3% of the solid lubricant.

0.5% zinc stearate serving as a binder was added to the mixed powder, and the resultant mixed powder was pressed under a pressure of 6.5 t/cm$^2$ to form a green compact. The green compact was heated to 650° C. for 1 hour to dewax, and the dewaxed green compact was sintered at 1180° C. for 2 hours. The sintered compact was quenched through gas cooling, and the quenched compact was subjected to tempering at 500° C. Finally, the tempered compact was worked to form a valve seat in a predetermined size for testing.

On the other hand, in Comparative Example 7, an iron powder serving as a pre-alloy powder (not containing niobium (Nb)) comprising 2% molybdenum (Mo), 1% chromium (Cr), 1% silicon (Si), and 3% vanadium (V) was mixed with carbonyl nickel, molybdenum (Mo), and graphite powders under 325 mesh, thereby preparing a base raw material powder having the composition shown in Table 1. In Comparative Example 8, a base raw material powder having the composition shown in Table 1 was prepared from the same raw materials as employed in Examples 1 to 6. In Comparative Examples 7 and 8, unlike Examples 1 to 6, a ferro-molybdenum powder serving as the hard particles composed of 60.87% molybdenum (Mo), 0.05% carbon (C), and the reminder of iron (Fe) (not containing boron (B)) was employed. The matrix raw materials were mixed with the hard particles and the same solid lubricant as in Examples 1 to 6 to prepare mixed powders. The same procedure as in Examples 1 to 6 was repeated to produce valve seats of Comparative Examples 7 and 8 for testing.

A wear resistance test was carried out on test pieces of Examples 1 to 6 and Comparative Examples 7 and 8 by use of a beating wear testing machine shown in FIG. 1. The test was carried out under conditions of; the number of revolutions: 2500 rpm and testing time: 5 hours, which simulate the actual operational conditions of an exhaust valve seat. A valve was formed from Stellite #12 through beading.

As shown in FIG. 1, the beating wear testing machine comprises burners 1 and 2, a combustion chamber 3, a valve seat holder 10 provided at the bottom of the combustion chamber 3, a valve seat 5 serving as a test piece held by the valve seat holder 10, sensors 6 and 7 which are thermocouples attached to the valve seat 5, a valve 4 vertically reciprocating through the valve seat 5 and a valve guide 8, and a cooling water channel 9 through the testing machine. The temperature of the valve seat holder 10 is controlled through cooling water. The valve 4 vertically reciprocates through the rotation of a camshaft 13. The beating wear testing machine further comprises a driveshaft 15 driven by a servomotor (not shown), a drive gear 16, a planetary gear 17, and a driven gear 18, thereby driving the valve 4 to rotate.

A valve seat (test piece) 5 was attached to the valve seat holder 10 in the beating wear testing machine, and the upper portion of the valve 4 supported by the valve guide 8 was brought into contact with the valve seat 5. Flame was thrown downward from the burners 1 and 2 toward the valve 4. The valve 4 was vertically reciprocated through the rotation of the camshaft 13. The test was carried out while adjusting the temperature of the valve seat 5 and the valve 4 to 350° C. In order to evaluate the wear resistance, the width of the contact surface of the valve seat 5 and the valve 4 was magnified by a factor of 500 in the vertical direction, and wear amount was evaluated by means of a shape measuring apparatus (not shown). FIG. 2 is a graph showing the wear amount (μm) determined through change in the width of the contact surface of the valve seat 5 and the valve 4 before and after the beating wear test.

Figure 2:
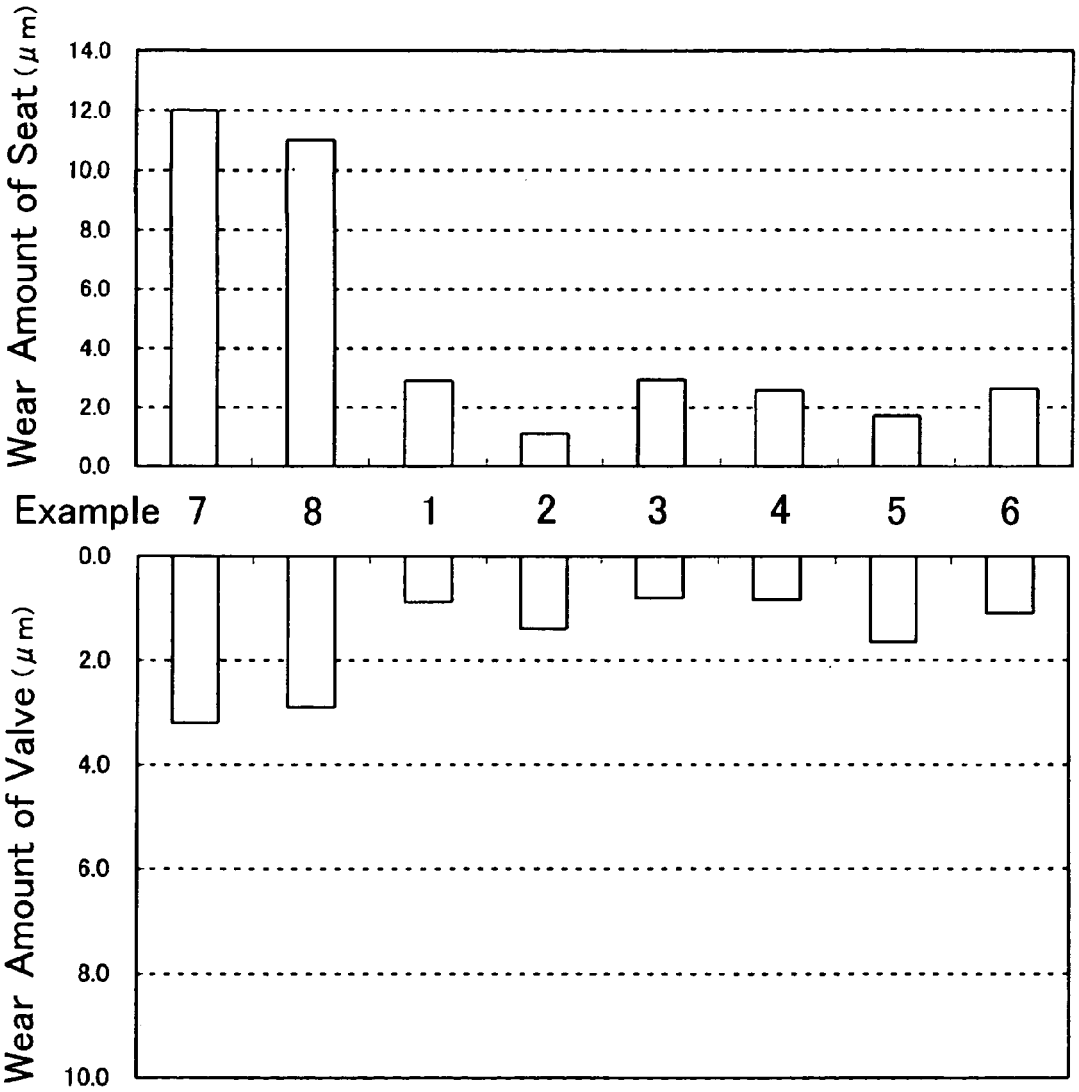
FIG. 2 is a graph showing the test results of the wear amounts.
Figure 3:
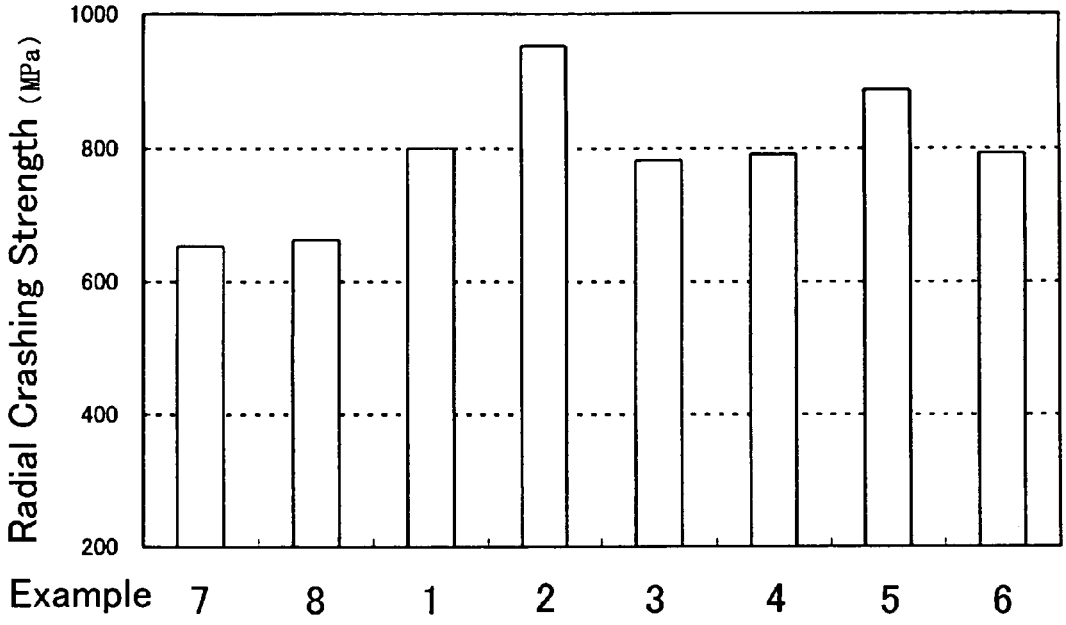
FIG. 3 is a graph showing the test results of the radial crashing strength at high temperatures.

As is clear from FIG. 2, the wear resistance is significantly improved in Examples 1 to 6 in which the ferromolybdenum hard particles containing boron are dispersed in the iron-based sintered alloy having a matrix comprising silicon, nickel, molybdenum, chromium, vanadium, and niobium compared with the wear resistance in Comparative Examples 7 and 8 in which ferromolybdenum hard particles not containing boron are employed. This is because the adhesive property between the hard particles and the matrix was improved through the addition of boron into the hard particles, and falling off of the hard particles due to impact at high temperatures was suppressed. According to the test results, the valve seat 5 produced from the iron-based sintered alloy with dispersed hard particles of the present invention has much improved wear resistance compared with the valve seats of the prior art.

Next, the radial crashing strength (MPa) of seat valves for Examples and Comparative Examples at high temperature was evaluated by means of a high temperature material testing apparatus (not shown). A valve seat formed into a ring shape was held by a jig (not shown), and a load was applied to the valve seat. The temperature was maintained at 500° C. during the test. The applied load was gradually increased, and the load at which a crack was generated in the valve seat was determined 2 times for each Example. The average of the measurements is shown in FIG. 3 as the test results. As is clear from FIG. 3, Examples 1 to 6 in which ferromolybdenum hard particles containing boron are employed exhibit higher radial crashing strength compared with Comparative Examples 7 and 8 in which ferromolybdenum hard particles not containing boron are employed. According to the test results, the valve seat produced from the iron-based sintered alloy with dispersed hard particles of the present invention has improved radial crashing strength at high temperature, as well as the wear resistance, compared with the valve seats of the prior art. It should however be appreciated that the content of boron is not limited to 0.89%, and similar results were obtained when the boron content was in the range of 0.3 to 1%.

It is to be understood that the present invention is not limited to the embodiments described above, and can be implemented in other embodiments, but also encompasses any modifications within the scope of the appended claims. It is within the scope of the invention to provide an iron-based sintered alloy with dispersed hard particles produced from a mixed powder not containing solid lubricant formed through uniformly mixing a matrix and hard particles. A solid lubricant other than lithium fluoride, calcium fluoride, barium fluoride, silicon nitride, boron nitride, manganese sulfide, molybdenum disulfide, and tungsten disulfide may be employed. Other materials may be added to the present matrix or the present hard particles, so long as the effect of the invention (i.e., improvement in the wettability of the ferromolybdenum hard particles through born) is not significantly inhibited. In addition, the components of the iron-based sintered alloy such as the matrix, the hard particles, and the solid lubricant may contain impurities which are unavoidably contained during or after the manufacturing process. In the present invention, the unavoidable impurities are not listed in the composition of the iron-based sintered alloy.

The present invention can be suitably applied to a component such as a valve seat for an automobile engine subjected to severe thermal and mechanical loads.

What is claimed is:

1. An iron-based sintered alloy with dispersed hard particles comprising:

a matrix comprising, by weight, 0.4 to 2% silicon (Si), 2 to 12% nickel (Ni), 3 to 12% molybdenum (Mo), 0.5 to 5% chromium (Cr), 0.6 to 4% vanadium (V), 0.1 to 3% niobium (Nb), 0.5 to 2% carbon (C), and the reminder of iron (Fe); and hard particles dispersed in the matrix in an amount in the range of 3 to 20% based on the entire alloy, the hard particle comprising 60 to 70% molybdenum (Mo), 0.3 to 1% boron (B), 0.1% or less carbon (C), and the remainder of iron (Fe), the iron-based sintered alloy being produced by sintering the matrix containing the hard particles.

2. The iron-based sintered alloy with dispersed hard particles according to claim 1, wherein the hard particles are mixed in the form of spherical powder adhere to the matrix.

3. The iron-based sintered alloy with dispersed hard particles according to claim 1 or 2 further comprising at least one solid lubricant selected from the group consisting of fluoride, nitride, and sulfide, in an amount in the range of 1 to 20%.

4. The iron-based sintered alloy with dispersed hard particles according to claim 3, wherein the solid lubricant is at least one selected from the group consisting of lithium fluoride (LiF), calcium fluoride ($CaF_2$), barium fluoride ($BaF_2$), silicon nitride ($Si_3N_4$), boron nitride (BN), manganese sulfide (MnS), molybdenum disulfide ($MoS_2$), and tungsten disulfide ($WS_2$).

5. The iron-based sintered alloy with dispersed hard particles according to claim 1, wherein the matrix contains a pre-alloy powder comprising 0.4 to 2.5% silicon (Si), 1 to 4% molybdenum (Mo), 0.5 to 5% chromium (Cr), 1 to 5% vanadium (V), 0.1 to 3% niobium (Nb), 0.8% or less carbon (C), and the reminder of iron (Fe).

6. The iron-based sintered alloy with dispersed hard particles according to claim 5, wherein the pre-alloy-powder-containing matrix comprises additive raw material powder, the additive raw material powder being at least one pure metal powder or alloy powder thereof selected from the group consisting of nickel powder, carbonyl nickel powder, molybdenum powder, and graphite powder, and the mixing ratio of the pre-alloy powder to the additive raw material powder falls within the range of 3:2 to 18:1.

* * * * *